US005787813A

United States Patent [19]

Reising

[11] Patent Number: 5,787,813

[45] Date of Patent: Aug. 4, 1998

[54] PRINTING MACHINE WITH REMOVABLE COMPONENTS

[76] Inventor: Michael Reising, Rubensstrasse 12, 63073 Offenbach, Germany

[21] Appl. No.: 597,464

[22] Filed: Feb. 2, 1996

[30] Foreign Application Priority Data

Feb. 4, 1995 [DE] Germany ..... 195 03 695.6

[51] Int. Cl.[6] ..... B41F 33/00

[52] U.S. Cl. ..... 101/479; 492/8; 492/9; 492/10; 492/18

[58] Field of Search ..... 101/479; 116/230; 492/8, 9, 10, 18; 384/448

[56] References Cited

U.S. PATENT DOCUMENTS

| | | | |
|---|---|---|---|
| 4,646,042 | 2/1987 | Eshelman | 335/205 |
| 4,912,291 | 3/1990 | Hepperle et al. | 200/82 E |
| 5,025,726 | 6/1991 | Funabashi et al. | 101/352 |
| 5,537,920 | 7/1996 | Hasegawa et al. | 101/116 |

FOREIGN PATENT DOCUMENTS

| | | |
|---|---|---|
| 37 34 525 A1 | 4/1989 | Germany . |
| 39 18 085 A1 | 12/1989 | Germany . |
| 42 40 487 C1 | 12/1993 | Germany . |
| 43 34 803 C1 | 11/1994 | Germany . |
| 43 24 631 A1 | 1/1995 | Germany . |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

A printing machine, particularly a sheet-fed offset printing machine, which has removable components, such as, in particular, inking-unit, dampening-unit or varnishing-unit rollers, is described. The printing machine includes an arrangement wherein it can be established, particularly via a control station of the printing machine, whether a component and which component is not properly installed. This measure is intended primarily to avoid malfunctions or even machine damage. This is achieved, according to the invention, in that the removable component has a permanent magnet which can be sensed by a sensor mounted fixedly relative to the frame of the printing machine at a point corresponding to the magnetic field produced by the permanent magnet. The signal or signals from one or more sensors are fed to an evaluation unit which determines the proper installation state from these signals.

7 Claims, 1 Drawing Sheet

PRINTING MACHINE WITH REMOVABLE COMPONENTS

BACKGROUND OF THE INVENTION

1. Field of the Invention

The present invention relates to a printing machine having removable components and, more particularly, to a printing machine having removable components and an assembly for determining the presence or absence of the removable components.

2. Discussion of the Related Art

Printing machines, particularly sheet-fed offset printing machines, often have a multiplicity of removable or exchangeable components. Examples of removable and/or exchangeable components, include the ink/dampening-medium carrying rollers of the inking/dampening units, the metering devices for inking units, dampening units, varnishing devices, additional sheet-guide devices or sheet-guide devices exchangeable according to the properties of the printing material, devices for the sheet feeding, sheet delivery and the like.

DE 4,240,487 CI discloses a roller mounting device in which inking-unit, dampening-unit or varnishing-unit rollers may be removably mounted.

DE 4,324,631 Al and DE 4,334,803 CI disclose metering and applicator devices for fluid media of differing viscosity, preferably various types of varnish, in which either a metering roller cooperates with an applicator roller (low-viscosity media) or a chamber doctor cooperates with a screened applicator roller (media of higher viscosity). The components are removably arranged between the side-frame walls of the printing unit. A disadvantage associated with printing machines having removable components is that it is impossible to see, particularly from a machine control station, that the corresponding component is missing. In the case of an offset or varnish printing machine, a removed inking-unit, dampening-unit or varnishing-unit roller may, under some circumstances, lead to malfunctions. If, for example, in a varnishing unit of the above-mentioned type, the chamber doctor together with the screened applicator roller is exchanged for a metering roller and an applicator roller provided with a smooth surface, and the metering roller is not inserted into the corresponding bearings, then, during an automatic supply of varnish, a considerable soiling of the machine parts located underneath, particularly of the sheet-guiding elements, occurs. If, in an inking or dampening unit, a roller is removed in order to exchange this for another roller, but the latter is inadvertently not inserted into the corresponding mounting, then, in this case too, considerable operating faults may occur, since the flow of ink and/or of the dampening medium is disrupted, if not even made impossible. It may be pointed out, furthermore, that machine damage or even personal injuries cannot be ruled out when particular components are being removed.

SUMMARY OF THE INVENTION

In accordance with one aspect, the present invention is directed to a system for determining the presence or absence of removable components in a printing machine. The system comprises a device for generating a magnetic field mounted to a removable component of the printing machine, a sensor for determining the presence of the magnetic field and generating an output signal indicative of the presence or absence of the magnetic field, and an evaluation unit coupled to the sensor for receiving the output signal indicative of the presence or absence of the magnetic field. The sensor is fixedly attached to a frame of the printing machine at a position corresponding to the position of the device for generating a magnetic field when the removable component is installed in its proper position. The evaluation unit includes means for generating a signal indicative of the presence or absence of a removable component from its proper position.

In accordance with the present invention, there is provision for arranging on the removable component at least one device generating a magnetic field, particularly in the form of permanent magnets. Arranged fixedly relative to the frame of the machine, so as to correspond to the position of the permanent magnet or permanent magnets in the installed state of the respective component, is a sensor which detects these magnetic fields and from which a signal can be extracted and fed to an evaluation unit. The evaluation unit can be connected to the control station of the machine, so that it can be indicated on a display device of the control station that the corresponding component is not properly positioned. In addition, multiple magnets and sensors may be utilized. In this case, the evaluation unit can be operatively connected to a plurality of sensors corresponding to the plurality of removable components, so that it is then also possible via the control station to display, for example, on which printing unit which roller has been removed. According to a further aspect of the present invention, there can be provision for the evaluation unit to block the main drive of the printing machine against starting when components particularly relevant to safety are being removed.

The invention is described in detail in exemplary embodiments given below with reference to a removable roller of an inking, dampening or varnishing unit. However, the present invention is not restricted to such an embodiment. The principle according to the invention can likewise be applied, for example, in the case of a removable chamber doctor. In this embodiment, a permanent magnet is mounted on the chamber doctor (at a suitable point), and a sensor unit, which is operable to detect magnetic fields, is mounted to the frame of the machine in a position which corresponds to the position of the permanent magnet in the installed state of the chamber doctor. In this way, other removable components can also be provided with a permanent magnet, to which a simple cost-effective sensor unit is correspondingly assigned.

According to another aspect of the present invention, there is provision, in the case of a removable chamber doctor, for mounting at least two permanent magnets closely to one another. These permanent magnets are interrogated by a sensor unit which is fixed relative to the frame and which, for example, has two reed contacts connected in series. In this case, an evaluation of the switching state of the reed contacts preferably also takes place within a short time interval, so that a determination of whether the chamber doctor is installed correctly can be made in a short time thereby ensuring safe operation of the device.

BRIEF DESCRIPTION OF THE DRAWINGS

Exemplary embodiments of a printing machine with removable components in accordance with the present invention is described below with reference to the accompanying drawings in which.

DETAILED DESCRIPTION OF THE PREFERRED EMBODIMENTS

Figure 1:
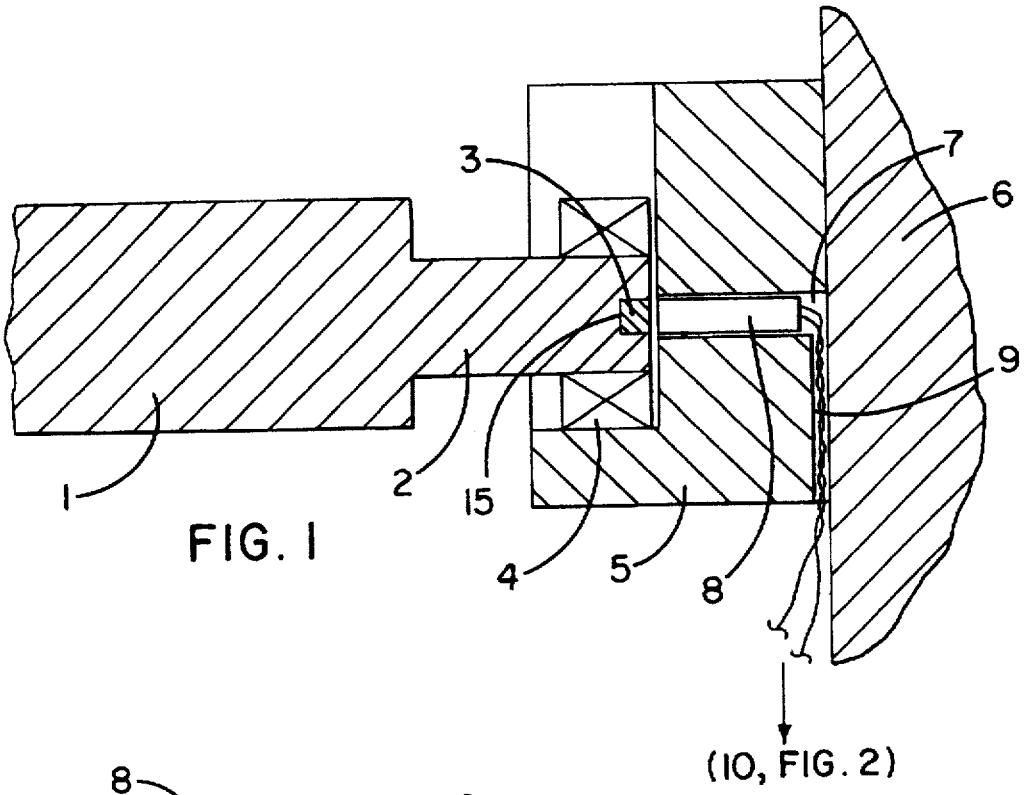
FIG. 1 shows the arrangement of a permanent magnet in a roller with the sensor in the roller bearing.

Generally, a roller of an inking, dampening or varnishing unit of a printing or varnishing machine has, at each of its two ends, a journal, on which an annular bearing is placed. FIG. 1 shows one end of the roller 1 of an inking, dampening, or varnishing unit with a journal 2 and a bearing 4. The journal 2 is inserted, together with the bearing 4 mounted thereon, in an upwardly open U-shaped bearing shell 5 which is mounted on a side-frame wall 6 of the printing or varnishing machine. Although not illustrated, the other end of the roller 1 also comprises a journal, bearing, and bearing shell mounted on a side-frame wall opposite the wall 6 of the printing or varnishing machine illustrated in FIG. 1. Accordingly, the bearing assembly described subsequently with reference to FIG. 1 is the same as the bearing assembly which is utilized on the opposite side-frame wall.

As illustrated in the exemplary embodiment of FIG. 1, a permanent magnet 3 is mounted in a recess 15 in an end wall of the journal 2. The recess 15 is centrally positioned in the axial direction relative to the end wall of the journal 2 and extends longitudinally into the journal 2 such that an outer end of the permanent magnet 3 is flush with the end wall of the journal 2 when the permanent magnet 3 is mounted in the recess 15. The permanent magnet 3 may comprise any magnetic material suitable for use in a printing or varnishing machine. For example, the permanent magnet 3 may comprise a ferromagnetic material such as iron. The permanent magnet 3 may be secured in the recess 15 by any suitable means such as an interference fit or by means of an adhesive or bonding agent.

A sensor 8 for detecting the magnetic field of the permanent magnet 3 is mounted in a bore 7 of the U-shaped bearing shell 5. The bore 7 in the bearing shell 5 is in axial alignment with the recess 15 in the journal 2 such that the sensor 8 is in axial alignment with the permanent magnet 3. The sensor 8 is mounted in the bore 7 such that an end closest to the permanent magnet 3 is flush with a wall of the bearing shell 5. The sensor 8 may be secured in the bore 7 by any suitable means, including a threaded connection.

According to the exemplary design of the U-shaped, upwardly open bearing shell 5, as shown in FIG. 1, the roller 1 can be removed from its normal operating position, i.e., the bearing 4 properly seated in the bearing shell 5, by an upward motion. When the roller 1 is in its normal operating position, the permanent magnet 3 is in alignment with the sensor 8 such that the measuring-field surface of the sensor 8 is in a position for measuring the full strength of the magnetic field produced by the permanent magnet 3. When the roller 1 is removed from its normal operating position, the permanent magnet 3 and the sensor 8 are no longer in alignment; therefore, no magnetic field can be sensed by the sensor 8. Similarly, if the roller 1 is not properly positioned, e.g., not properly aligned, the permanent magnet 3 and the sensor 8 are no longer in proper alignment and thus a much weaker magnetic field or no magnetic field may be sensed by the sensor 8. Accordingly, the sensor 8 and permanent magnet 3 may be utilized to determine when the roller 1 is properly positioned, misaligned, and/or removed from its normal operating position.

The sensor 8 may comprise any suitable device for detecting a magnetic field, for example, in a simple form, a reed contact or a sensor which operates on a magnetoresistive principle, and which outputs a signal indicative of the presence or absence of the magnetic field. In addition, the sensor 8 may output a signal indicative of the relative strength of the magnetic field so that misalignment of the roller 1 may be detected. In a preferred embodiment, the sensor 8 comprises a reed contact device, i.e., a switch, which opens and closes in response to the presence or absence of a magnetic field.

The sensor 8 may include wire leads 16 which carry the signal indicative of the sensed magnetic field. The wire leads 16 may extend through a portion of the bore 7 and through a groove 9 in the bearing-shell 5. The groove 9, which opens into the bore 7 in the manner of a taphole, may be in the rear side of the U-shaped bearing shell 5, which is the side facing away from the roller 1. The sensor 8 can preferably be designed with a substantially tubular configuration and provided with external threads. The bore 7 in the bearing shell 5 may also comprise internal threads so that the sensor 8 may simply be threaded into the bore 7. Accordingly, the wire leads 16 extend through the bore 7 to the groove 9 and connect to an evaluation unit 10 which is utilized to evaluate the presence or absence of the particular component, described in detail below.

Figure 2:
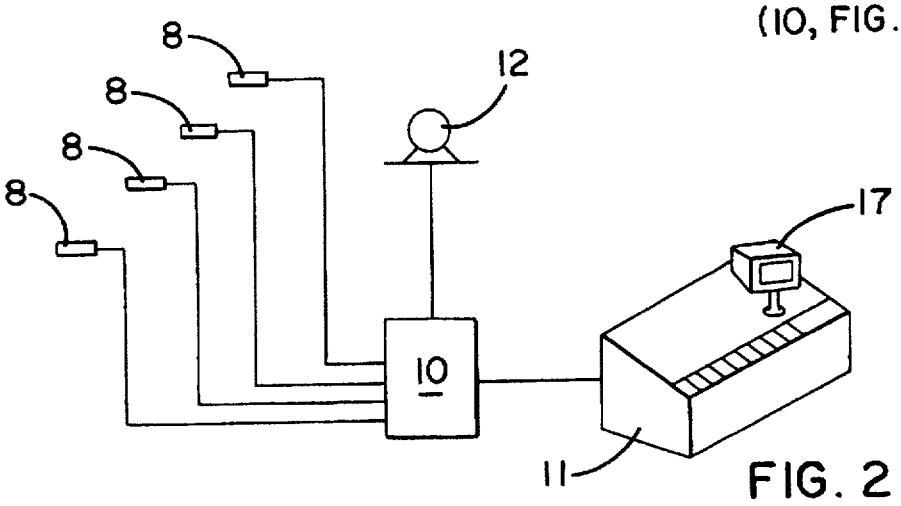
FIG. 2 shows the connection of a plurality of sensors to an evaluation unit.

FIG. 2 shows by way of example the connection of a plurality of sensors 8, corresponding to a plurality of rollers 1 or the like, in a printing machine (not shown) to a single evaluation unit 10. Preferably, in this case, each sensor 8 is connected to the evaluation unit 10 so as to be capable of being interrogated individually. For example, the evaluation unit 10 may comprise a polling arrangement through which each of the individual sensors 8 may be polled at predetermined intervals. As described above, each of the sensors 8 output signals indicative of the presence or absence of a magnetic field, which in turn may be utilized to determine whether a roller or other component is properly installed. Therefore, the evaluation unit 10 receives the signals output by the sensors 8, processes the signals, and transmits the processed signals to other devices. In one embodiment, the evaluation unit 10 may be connected to a control station 11, which is utilized to control the overall operation of the printing machine. In this embodiment, the evaluation unit 10 may be configured to generate a first signal when a sensor 8 outputs a signal indicating that no magnetic field is detected and a second signal indicating that a magnetic field is detected. Alternatively, the evaluation unit 10 may be configured to generate a single signal indicating that no magnetic field is detected. The signal or signals output by the evaluation unit 10 to the control station 11 may be utilized by the control station 11 to determine whether a roller or other component of the printing machine is present or not present. The control system 11 may comprise a monitor 17. The monitor 17 may be utilized to display the status, e.g., installed or removed, of a component or components. In the exemplary embodiment, the control station 11 may comprise a microprocessor and associated memory, for example, a personal computer. As stated above, the control station 11 controls the operation of and monitors the status of the printing or varnishing machine.

As illustrated in FIG. 2, the evaluation unit 10 may also be connected to an electrical drive unit 12 of the printing machine. The sensors which are operatively associated with the components particularly relevant to the safety of the operator of the printing machine or to the functioning of the printing machine can then, through the evaluation unit 10, prevent the electrical drive unit 12 from supplying power to the printing machine, thereby preventing the printing machine from operating. Accordingly, if a relevant component or components is/are not installed or not properly installed, operation of the printing machine is prevented because of the signal or signals from the sensors 8. In addition, the display monitor 17 of the control station 11 may display a fault message corresponding to the reason why the machine in not operational along with an indication as to which component or components is/are missing.

In accordance with an important aspect of the present invention, the interrogation or polling of the sensor or sensors 8 by the evaluation unit 10 takes place based on whether the function to which the corresponding component belongs is also selected. This means, for example, that an inking-unit roller can be absent in a non-printing printing unit, whereas, in the connected printing unit, the absence of the inking-unit roller prevents the printing machine against starting.

The evaluation unit 10 comprises a microprocessor and associated memory. The evaluation unit 10 may be preprogrammed to poll the various sensors 8 at predetermined intervals. Accordingly, since each sensor may be polled individually, isolation of a defectively or incorrectly installed component may be achieved rapidly. For example, the evaluation unit 10 may include detection circuitry associated with each sensor 8 which is similar to the detection circuitry shown in U.S. Pat. No. 5,025,726. U.S. Pat. No. 5,025,726 being hereby incorporated by reference for it's teaching on detection circuitry which determines the presence or absence of external conditions. In addition, as stated above, the evaluation unit 10 may comprise software stored in memory which is responsible for determining the configuration of the particular machine to which it is attached in order to determine which component or components are necessary for proper machine operation as described above. The evaluation unit 10 also comprises software capable of sending a signal to the electrical drive unit 12 to prevent machine operation in the situation where the particular component or components which is/are not properly installed would result in damage to the machine or pose a safety risk to the system operator. The evaluation unit 10 may comprise interface circuitry for communication with the sensors 8, the electrical drive unit 12 and the control station 11.

More than one sensor and more than one permanent magnet may be utilized in a particular component. For example, a permanent magnet and sensor combination may be utilized on each end of the roller. Accordingly, when only a single end of the roller is out of position, it may be detected by the evaluation unit.

Figure 3:
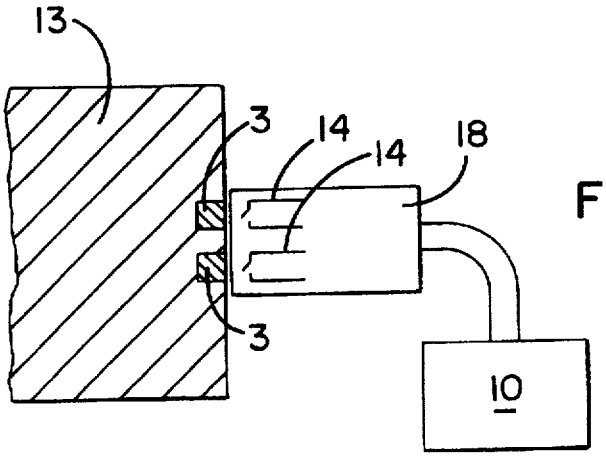
FIG. 3 shows a device for interrogating a chamber doctor.

FIG. 3 illustrates an arrangement for evaluating the installation and positioning of a chamber doctor 13 in, for example, a varnishing machine (not illustrated). The arrangement includes two permanent magnets 3, which may be identical to the permanent magnets 3 described above with respect to FIG. 1 and 2, and a sensor unit 18. The two permanent magnets 3 are mounted in a housing of the chamber doctor 13 such that one pole face of each permanent magnet 3 is flush with the wall of the housing of the chamber doctor 13. The permanent magnets 3 may be mounted in the housing of the chamber doctor 13 by any suitable means such as an interference fit or by an adhesive. Mounted to a frame wall of the varnishing machine, neither of which is illustrated in FIG. 3, in a position opposite to and within the magnetic field generated by the two permanent magnets 3 is the sensor 8. In the exemplary embodiment, the sensor unit 18 comprises two reed contacts 14 which may be separately switched by the permanent magnets 3 when the chamber doctor 13 is installed and positioned properly within the varnishing unit. The sensor unit 18, like the sensors 8 described above, may be connected to an evaluation unit 10. The evaluation unit 10 may be the same evaluation unit to which the other sensors 8 (FIGS. 1 and 2) are connected. The evaluation unit 10 polls the switching state, e.g., open or closed, of the reed contacts 14 at a predetermined rate, which is preferably a short interval of time to ensure correct operation of the varnishing unit.

Two magnets and two sensor switches are utilized to ensure a high degree of accuracy in the positioning of the chamber doctor 13. In addition, the two magnets are mounted such that the pole faces are of opposite polarity.

Although shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A system for determining the presence or absence of removable rollers in a printing machine comprising:

(a) a roller including at least one journal having a recess in an end thereof, the recess being centrally positioned in the axial direction relative to the end of the at least one journal, a permanent magnet mounted in the recess for generating a magnetic field;

(b) a sensor for determining the presence of the magnetic field and generating an output signal indicative of the presence or absence of the magnetic field, the sensor fixedly attached to a frame of the printing machine at a position corresponding to the position of the permanent magnet when the roller is in its proper position; and (c) an evaluation unit coupled to the sensor for receiving the output signal indicative of the presence or absence of the magnetic field, the evaluation unit including means for generating a signal indicative of the presence or the absence of a roller from its proper position.

2. The system according to claim 1, wherein the permanent magnet is mounted in the recess of the at least one journal such that a pole face outer end of the permanent magnet is flush with the end of the at least one journal.

3. The system according to claim 1, wherein the at least one journal of the roller is seated in a bearing assembly including a bearing and bearing shell, the bearing shell including a bore therethrough, the bore being in axial alignment with the recess in the at least one journal of the roller.

4. The system according to claim 3, wherein the sensor is mounted within the bore of the bearing shell such that an end of the sensor is flush with a wall of the bearing shell.

5. The system according to claim 1, further comprising a plurality of sensors corresponding to the plurality of removable components, and the plurality of sensors are connected to the evaluation unit so as to be capable of being interrogated individually.

6. The system according to claim 1, wherein the evaluation unit is connected to a control station of the printing machine, the control system including a display device for indicating in visual format the absence of one or more components.

7. The system according to claim 1, wherein the evaluation unit is operatively connected to a drive of the printing machine and is designed for the purpose of causing the drive to stop when at least one of the sensors outputs a signal indicative of the absence of a removable component.

* * * * *